US008601744B2

(12) United States Patent
Wildförster et al.

(10) Patent No.: US 8,601,744 B2
(45) Date of Patent: Dec. 10, 2013

(54) DOOR ACTUATOR WITH AN ACTUATOR UNIT

(75) Inventors: Thomas Wildförster, Schwelm (DE); Michael Hufen, Wuppertal (DE); Matthias Drux, Gevelsberg (DE)

(73) Assignee: Dorma GmbH + Co. KG, Ennepetal (DE)

( * ) Notice: Subject to any disclaimer, the term of this patent is extended or adjusted under 35 U.S.C. 154(b) by 442 days.

(21) Appl. No.: 12/742,567

(22) PCT Filed: Nov. 13, 2008

(86) PCT No.: PCT/EP2008/009560
§ 371 (c)(1),
(2), (4) Date: Aug. 4, 2010

(87) PCT Pub. No.: WO2009/062698
PCT Pub. Date: May 22, 2009

(65) Prior Publication Data

US 2010/0293856 A1 Nov. 25, 2010

(30) Foreign Application Priority Data

| | | |
|---|---|---|
| Nov. 13, 2007 | (DE) | 10 2007 054 460 |
| Nov. 13, 2007 | (DE) | 10 2007 054 462 |
| Nov. 13, 2007 | (DE) | 10 2007 054 463 |
| Nov. 13, 2007 | (DE) | 10 2007 054 464 |

(51) Int. Cl.
*E05F 11/00* (2006.01)

(52) U.S. Cl.
USPC ..... 49/324

(58) Field of Classification Search
USPC ..... 49/352, 324; 74/606 R
See application file for complete search history.

(56) References Cited

U.S. PATENT DOCUMENTS

| | | | | |
|---|---|---|---|---|
| 3,766,801 | A * | 10/1973 | Wiegand | 74/480 B |
| 5,768,942 | A * | 6/1998 | Gruber et al. | 74/89.14 |
| 6,006,475 | A | 12/1999 | Schwantes et al. | |
| 6,530,178 | B1 | 3/2003 | Kowalczyk et al. | |
| 7,073,291 | B2 * | 7/2006 | Kawanobe et al. | 49/26 |
| 7,472,515 | B2 * | 1/2009 | Mazouzi et al. | 49/352 |
| 2005/0150324 | A1 | 7/2005 | Brieseck | |

FOREIGN PATENT DOCUMENTS

| | | |
|---|---|---|
| DE | 40 21 669 | 2/1992 |
| DE | 101 01 515 | 8/2002 |
| WO | WO 2004/035977 | 4/2004 |

* cited by examiner

*Primary Examiner* — Katherine Mitchell
*Assistant Examiner* — Catherine A Kelly
(74) *Attorney, Agent, or Firm* — Cozen O'Connor

(57) ABSTRACT

The present invention relates to a door operator (1) with a drive unit, wherein the drive unit presents a gear with a gear housing (2).
According to the invention, it is intended that the gear housing (2) has at least one first shell element (3) and at least one second shell element (4), wherein the shell is elements (3, 4) are able to be brought into mutual abutment for forming an inner gear compartment (5).

15 Claims, 8 Drawing Sheets

DOOR ACTUATOR WITH AN ACTUATOR UNIT

Figure 1:
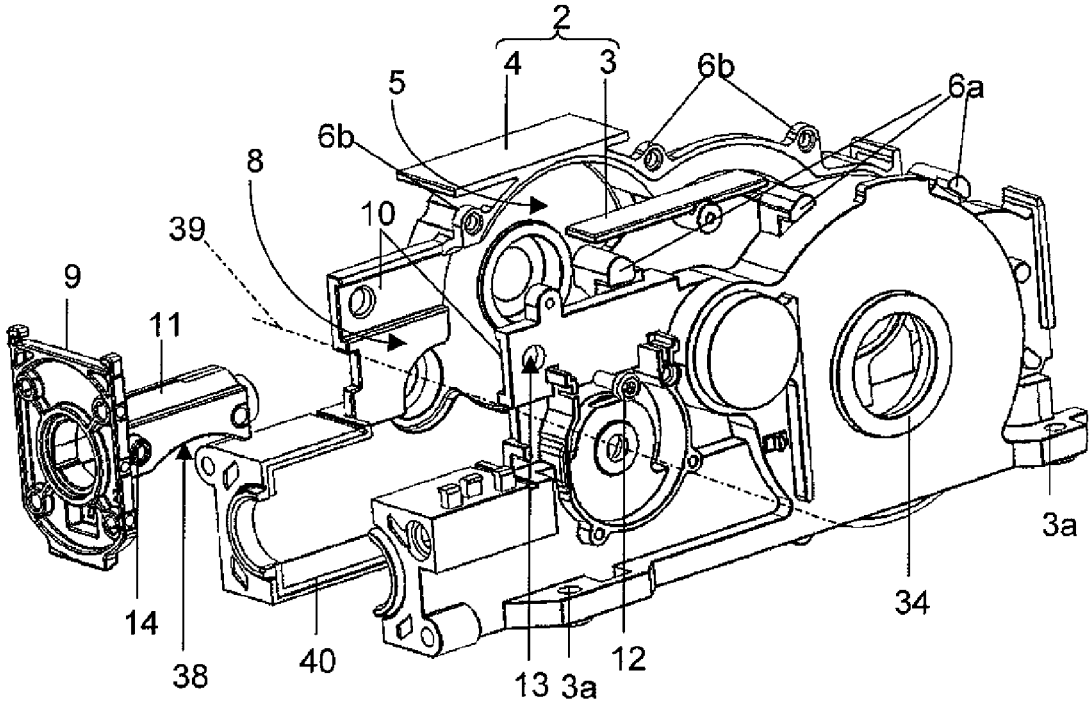

The present invention relates to a door operator with a drive unit, wherein the drive unit presents a gear with a gear housing.

Door operators of the species discussed here are often configured as electro-mechanical or electro-hydraulic door operators and serve for actuating a door leaf of a door system. The door operator is mounted for example at the door transom, at a wall or at the door leaf, and the actuation of the door leaf is realized via an arm assembly, which is disposed on an output shaft, which extends from the gear housing.

The drive unit comprises furthermore an electrical motor such that the gear is disposed as motion-transmitting, namely for transmitting the rotational movement between the output shaft of the motor and the output shaft of the door operator.

The problem with such gear systems is that, depending on the size of the door system and the weight of the door leaf, very often high torques need to be provided via the output shaft of the door operator. This results in substantial requirements as to the reinforcement of the gear housing in order to ensure a trouble-free and long-term operation of the door operator. Furthermore, the disposition of the electrical motor adjacent to the gear is very complicated, if the motor is disposed at the carrying body of the door operator and if no rigidity-forming connection is given between the electrical motor and the gear. Furthermore, known gear housings consist of a plurality of individual components which call for a complicated mounting.

Therefore, it is the object of the present invention to overcome the aforementioned shortfalls, and to provide a gear housing which has a high rigidity and is easy to install.

This problem is solved based on a door operator with a drive unit according to the generic part of claim 1, in conjunction with the characterizing features. Advantageous further developments of the present invention are indicated in the dependent claims.

The invention includes the technical teaching that the gear housing has at least one first shell element and at least one second shell element, wherein the shell elements can be brought into mutual abutment, in order to form an inner gear compartment.

The advantage of the inventive configuration of the gear housing is based on a considerably simplified mounting, because just two shell elements need to be brought into mutual abutment. The plane of division of the gear housing, formed by the plane of contact of the shell elements placed against each other, extends approximately centrally through the gear body.

Door operators comprise mostly a mounting plate by means of which the door operator is mounted at the door transom or for example at the wall. The plane of division of the shell elements extends almost vertically from the plane of extension of the mounting plate. Both shell elements contribute to form the inner gear compartment such that none of the shell elements simply serves as a cover element, whereby the higher rigidity of the gear housing is achieved. The gear shafts, including the associated gear teeth, disposed in the inner gear compartment are supported with their respective end in both, the first shell element and the second shell element. As a consequence, at least one of the shell elements has a breakthrough, through which the output shaft of the door operator is guided out of the gear housing.

It is of advantage if the shell elements are manufactured from a cast metal component, from a metal die-casting or from a plastic material injection moulding component. Subsequently, the functional surfaces of the shell elements can be finished by machining. These functional surfaces comprise in particular the surfaces via which the shell elements are brought into mutual abutment. A surrounding shoulder, which creates a positive connection of the two shell elements to each other, according to a type of a tongue-and-groove joint, may be provided in the respective contact surface of the shell elements. The rigidity of the gear housing, formed by the shell elements, is thereby furthermore increased and the accurately positioned alignment of the shell elements with regard to each other is ensured.

Advantageously, the shell elements have respectively associated fastening mouldings, by means of which the shell elements are connectable to each other, preferably by screw elements. Plate-shaped mouldings with a through-opening may be provided at a first shell element, through which the screw elements can pass. The second shell element in turn has dome-shaped fastening mouldings, which comprise a threaded bore, into which the screw elements are screwable. If the shell elements are brought into mutual abutment, the through-openings in the plate-shaped mouldings of the first shell element are in true alignment with the dome-shaped mouldings of the second shell element, such that, for mutually screwing the shell elements, the respective screw elements can be screwed into the mouldings.

As an alternative, the dome-shaped fastening mouldings do not have threaded bores, but bores without thread, into which the screw elements, namely so-called thread-tapping, thread-cutting or thread-forming screws cut a thread into the respective bore when being screwed in and are thus reliably tightened.

It is furthermore advantageous if at least one of the dome-shaped fastening mouldings forms a projection on the rear-side, by means of which a defined guiding and/or fixing of at least one electrical line is possible at the gear housing. The projection creates an undercut, which is shaped between the projection and the gear housing or components disposed at the gear housing. Cables, for example, which extend over the length of the door operator through this undercut, may be inserted into the latter. This allows for a defined guiding of the electrical lines, such that they are neither located unfastened at the door operator, nor do they have to be fastened at another location by means of further expensive cable fasteners.

According to another advantageous embodiment of the door operator, the shell elements brought into mutual abutment form a reception tunnel, in which a flange element is receivable via a groove guide provided in the reception tunnel. Overall, the shell elements, brought into mutual abutment, form a closed gear housing, wherein however a reception tunnel may be provided in which the flange element is received. The reception tunnel has a groove guide, which extends in the joining direction of the flange element for affixing it to the gear housing.

If the shell elements are brought into mutual abutment, the flange element can be slid into the reception tunnel via a guide section provided at the flange element. The flange element serves for receiving an electrical motor, wherein the guide section is additionally configured for bearing and/or supporting a gear member of the motor, which is configured for example in the shape of a gear worm, a bevel gear, a crown wheel or the like. Either the flange element may be fastened first to the gear housing, in order to subsequently affix the motor to the flange element, or the motor is already connected to the flange element and the flange element, together with the motor, is affixed to the gear housing. The guide section has at least one threaded bore for freely mounting the flange element at the gear housing, wherein at least one of the shell elements has an associated screw passage. If the guide section is completely introduced into the reception tunnel, the former may be screwed to the shell elements by means of at least one screw element, by passing the screw element through the screw passage and screwing it tight in the threaded bore.

The motor may have a gear worm on the output shaft such that the guide section of the flange element is configured to be open at least at one side. The gear worm may cooperate with a worm wheel via the open side of the guide section, which wheel is received transversely to the direction of rotation of the gear worm in the gear housing. The inventive configuration of the reception tunnel and of the flange element, which can be received therein, allows for affixing the electrical motor to the gear housing in a simple manner, such that the gear housing can be executed nevertheless as a closed housing, wherein the fact of screwing the shell elements to the flange element at both sides allows for an additional increase in the rigidity of the overall arrangement of the gear with the electrical motor.

It is furthermore intended that the door operator comprises a spring force accumulator and that the gear housing has a reception surface for receiving the spring force accumulator, which surface is formed in a single plane by the shell elements in their joined condition. In the installed condition, the spring force accumulator, seen in its longitudinal extension, may be disposed parallel with regard to the axis of rotation of the output shaft of the electrical motor. The reception surface for receiving the spring force accumulator is disposed adjacent to the reception tunnel of the gear housing, such that the spring force accumulator can be disposed at the gear housing below the electrical motor.

A liner plate may be provided which can be disposed at the reception surface in a flat abutment. As a consequence, the liner plate is located between the reception surface and the mounting surface provided at the spring force accumulator. From the reception surface may extend a collar, which forms a ring-shaped collar when the collar sections are joined together, which are moulded to the shell elements, and which collar serves to receive the liner plate in a centring manner, because the collar is configured to be inserted into a centering opening provided in the liner plate. In this case, the collar may extend through the centering opening in the liner plate and engage in a surrounding groove in the mounting surface of the spring force accumulator.

The liner plate may be configured to be screwable to the shell elements, wherein the spring force accumulator has at least one insert projection which is insertable into at least one insert recess in the shell elements. An additional centring of the spring force accumulator at the shell elements is thereby created, wherein, by screwing the liner plate to the two shell elements and by inserting the collar in the centring opening of the liner plate, a further increase in the overall rigidity for the gear housing is achieved. It is impossible to push the shell elements apart in transverse direction, because the collar sections respectively extend into the centring opening, wherein the rigidity increasing disposition of the liner plate at the shell elements on account of the screwing likewise has the effect of increasing the rigidity.

An additional function of the gear housing is achieved in that the shell elements have plane surface areas respectively configured at the upper side, which areas, with the shell elements being brought into mutual abutment, extend in one common plane surface. The possibility is thereby created to guide a flat cable across the gear housing, which extends through the door operator.

Furthermore, an incremental encoder may be provided, wherein at least one of the shell elements is configured to receive the incremental encoder, which is disposed preferably on the outside of the respective shell element. The shell element, in which the incremental encoder is received, may include a shaft passage, through which a transmission shaft extends, in order to cooperate with the incremental encoder.

Mounting the incremental encoder may be realized via a latching moulding which is affixed to the housing of the incremental encoder. The latching moulding may latch in a latching recess which is provided at the shell element. Finally, the housing of the incremental encoder may be affixed to the appropriate shell element accurately positioned and in a captive manner by means of a screw connection.

It is furthermore intended that a radio set may be affixed to at least one of the shell elements. The radio set serves for wireless communication from the control of the door operator to an external communication means. For disposing the radio set, the appropriate shell element has a fastening pin, in which, like in the above described dome-shaped fastening mouldings, here again a bore is provided with or without female thread, via which bore the radio set can be screwed to the shell element.

Very often door operators have a system carrier, wherein the gear system is screwed to or latched on the system carrier. In order to improve guiding the flat cable through the entire door operator, together with the plane surface formed by the shell elements, the system carrier may likewise comprise a flat cable guide. In order to realize an advantageous disposition of the respective components of the door operator, several electronic units may be provided, which are locally separated in the drive and interconnected by means of the flat cable. As a consequence, a reliable guiding of the flat cable is required within the door operator. The flat cable guide of the system carrier may comprise a fork-like moulding into which the flat cable can be inserted.

Figure 2A:
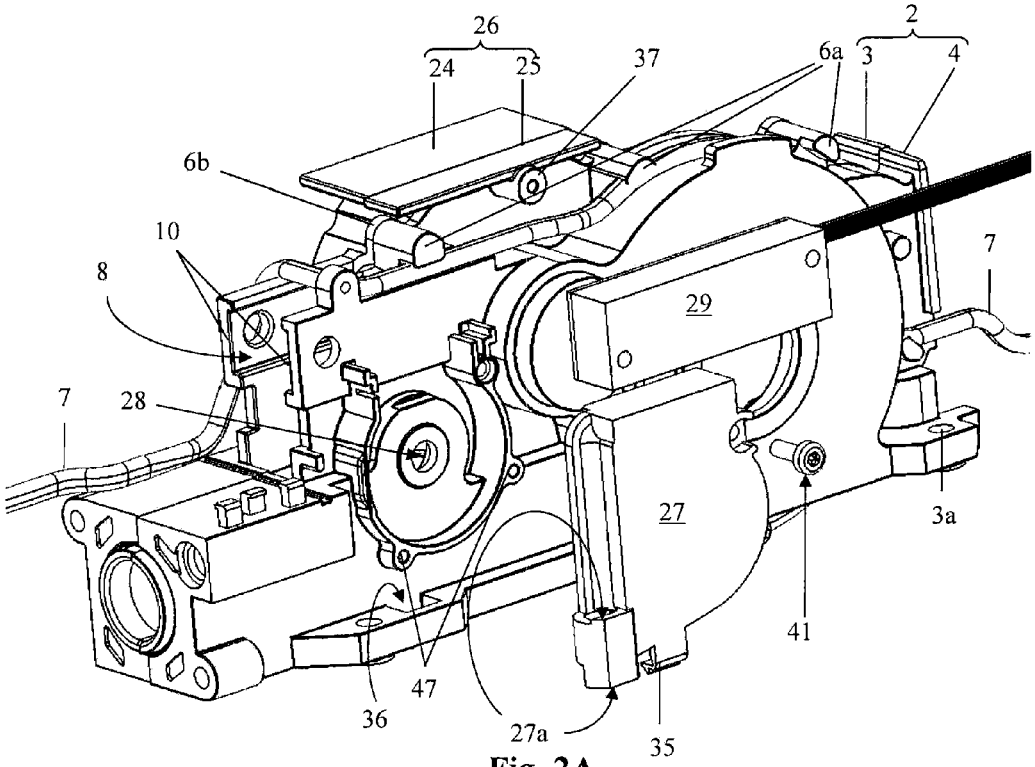
Figure 2B:
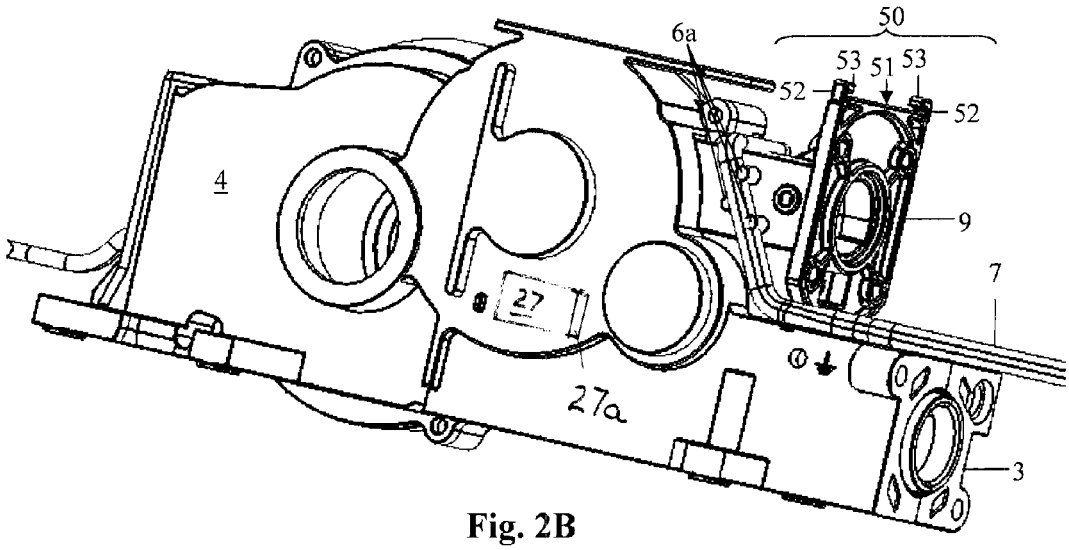
Figure 3:
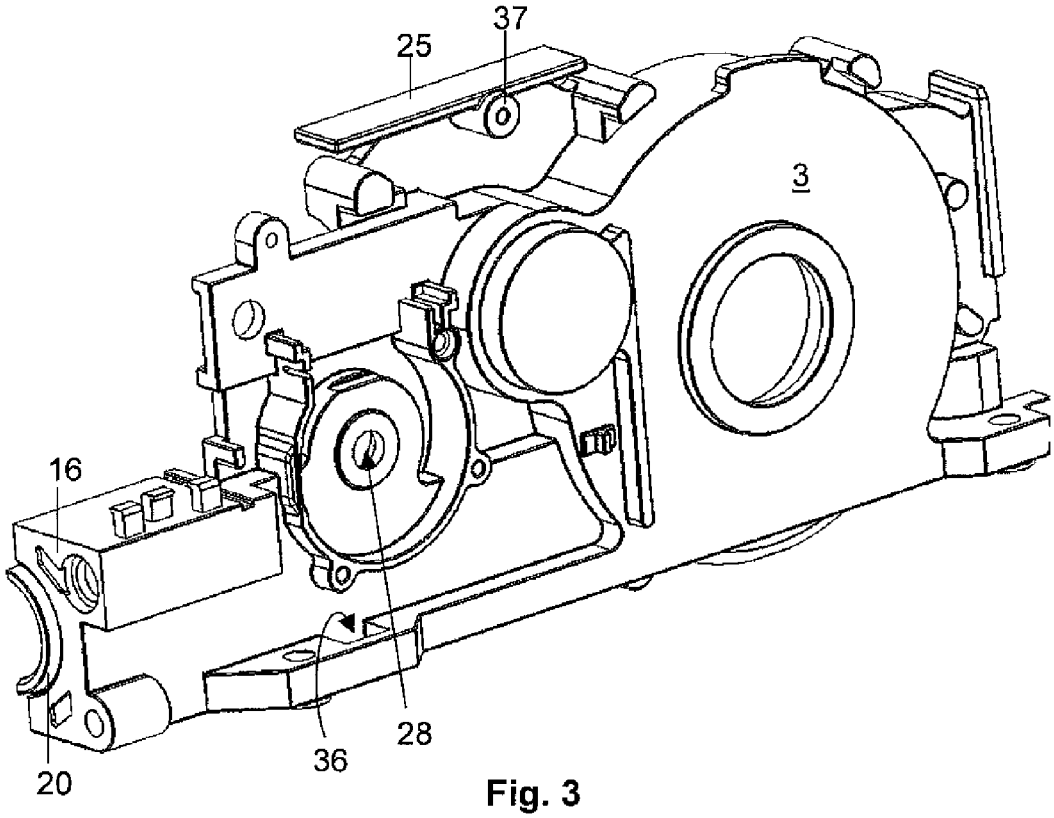
Figure 4:
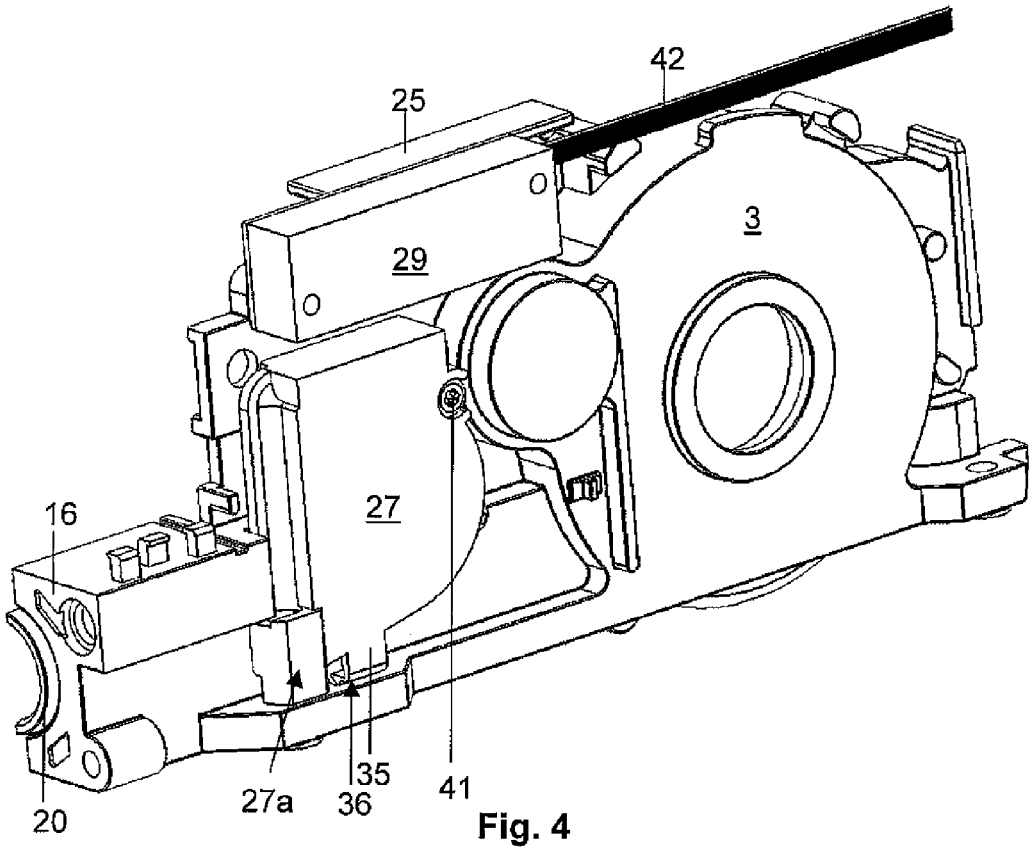
Figure 5:
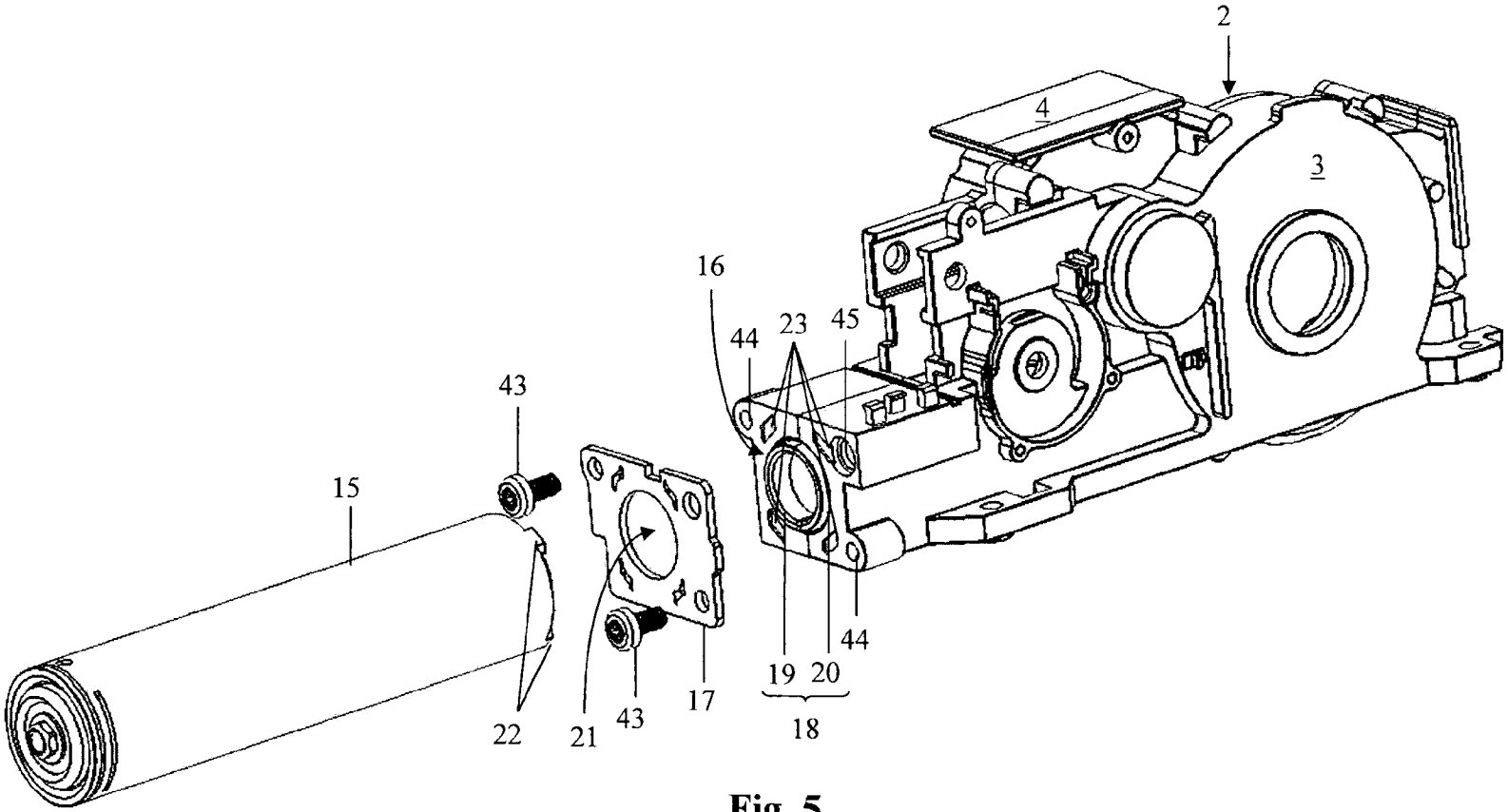
Figure 6:
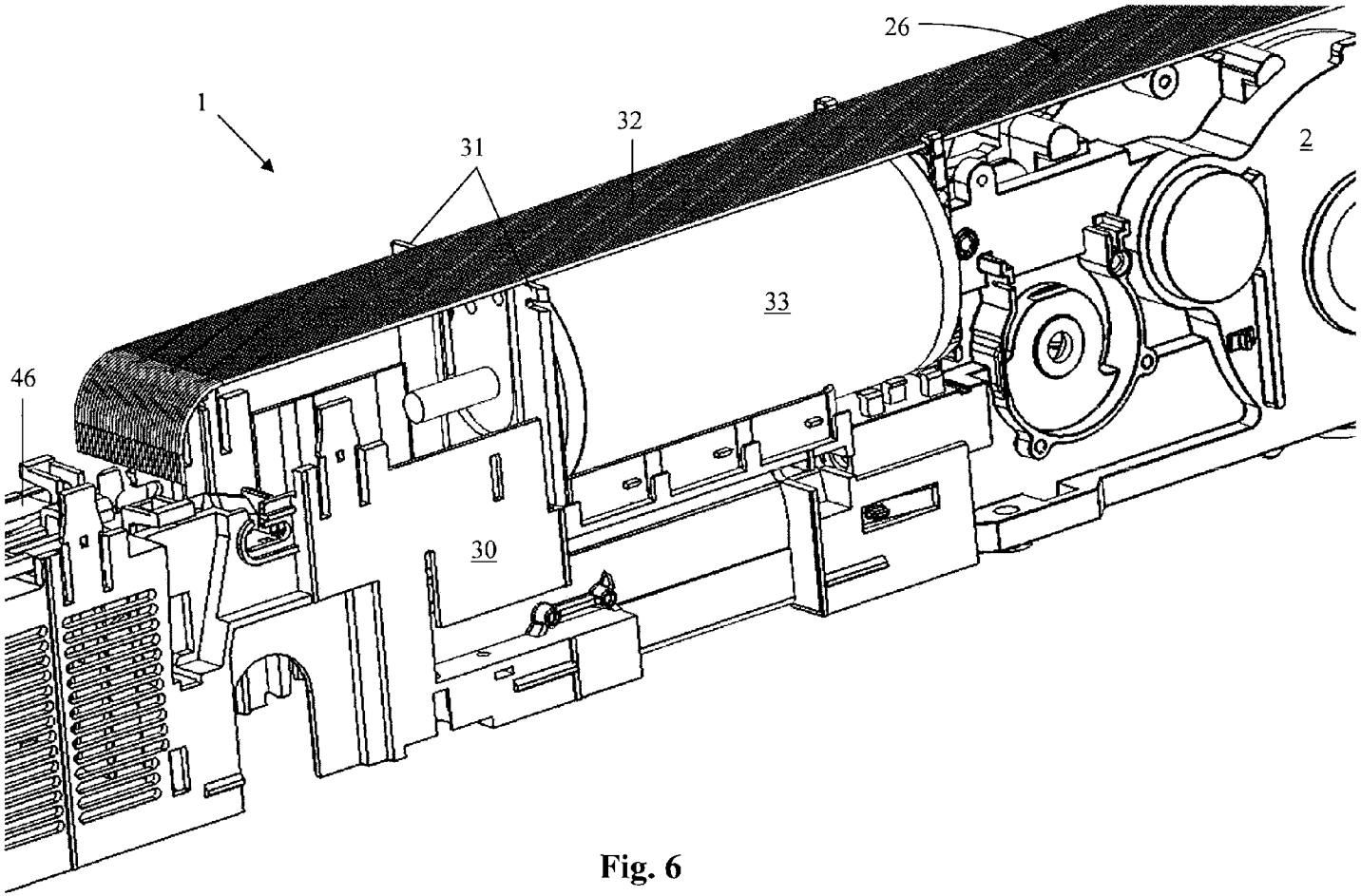
Figure 7:
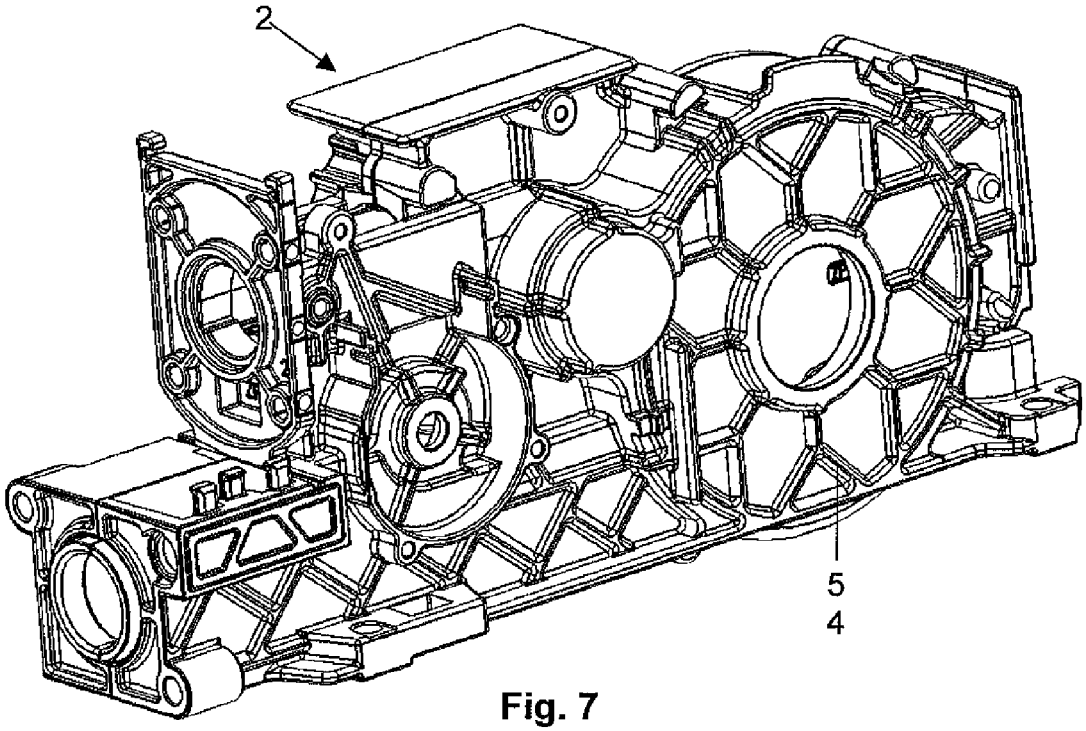

Hereinafter, further measures enhancing the invention will be illustrated in detail in conjunction with the description of one preferred embodiment of the invention, based on the Figures, in which:

FIG. 1 shows a perspective view of an embodiment of the gear housing of a door operator, wherein the shell elements and the flange element are illustrated in the non-installed condition, FIG. 2 shows a perspective view of the gear housing with the shell elements, which are brought into mutual abutment, FIG. 3 shows a perspective view of a first shell element without the incremental encoder and the radio set being installed, FIG. 4 shows a perspective view of the shell element according to FIG. 3 with the incremental encoder and the radio set being installed, FIG. 5 shows a perspective view of the gear housing as well as of the spring force accumulator in the installed disposition, FIG. 6 shows a partial perspective view of the door operator with a flat cable guide for guiding a flat cable, and FIG. 7 shows a modified gear housing.

FIG. 1 illustrates an embodiment of a gear housing 2 for a door operator in a perspective view. The gear housing 2 comprises a first shell element 3 and a second shell element 4. The shell elements 3 and 4 are illustrated as spaced apart from each other, and can be brought into mutual abutment such that the gear housing 2 forms an inner gear compartment 5. Several transmission shafts can be received in the inner gear compartment 5 such that a drive, constituted by an electrical motor, acts on an output shaft of the door operator, which shaft can protrude from the gear housing 2 through the illustrated breakthrough 34.

Furthermore, a flange element 9 is shown, which is adjoined by a guide section 11. The guide section 11 may be inserted into a reception tunnel 8, wherein a groove guide 10 in the respective half-shell 3, 4 allows for an accurately positioned affixing of the flange element 9 by means of the corresponding geometry of the guide section 11. The flange element 9 serves for receiving the electrical motor such that the motor output shaft can extend into the guide section 11. The guide section 11 has an opening side 38, wherein a gear worm may be placed onto the motor output shaft, which worm is accessible through the opening side 38 such that the gear worm can be brought into engagement with a worm wheel, which is received in the shell elements 3 and 4 and is rotatable about the worm wheel axis 39.

The shell elements 3 and 4 may be screwed to each other via fastening mouldings 6*a* and 6*b*. The fastening mouldings 6*b* are configured as plate-shaped mouldings with a through-opening, whereas the fastening mouldings 6*a* are configured as dome-shaped mouldings provided with a threaded bore therein. If the shell elements 3 and 4 are brought into mutual abutment, the shell elements 3 and 4 can be screwed to each other via the fastening mouldings 6*a* and 6*b*.

A surrounding shoulder 40 is provided in the contact surfaces of the shell elements 3 and 4, which are brought into mutual abutment. A positive engagement of the shell elements with each other is thereby obtained, whereby an increase in the overall rigidity of the gear housing 2 is achieved. A further increase in the overall rigidity results from screwing, respectively from laterally placing, in FIG. 1, the shell elements 3 and 4 with or onto the guide section 11 of the flange element 9. In the guide section 11, preferably on each side of the guide section 11, respectively one protruding projection is configured in the direction of the respective shell element 3, 4. When placing the respective shell element 3, 4, the respective projection preferably reaches a positive engagement in a corresponding insert opening 13 of the respective half-shell 3, 4, and thereby simultaneously centers and positions preferably the guide section 11 at the respective shell element 3, 4. Threaded bores 14 may be provided in both projections, wherein only a front threaded bore 14 is shown. A screw element 12, shown by way of example in FIG. 1, may be passed through the right hand insert opening 13 and screwed in the threaded bore 14. The rear shell element 4 may be likewise screwed to the guide section 11 of the flange element 9, whereby the flange element 9 is held accurately positioned within the reception tunnel 8.

However, the screw element 12 and the threaded bore 14 may be foregone, as long as the half-shells 3, 4 are already reliably fastened to each other by the other fastening means.

For fastening the gear housing 2, respectively the door operator 1 itself, the gear housing 2 has preferably fastening openings 3*a*, through which non-illustrated attachment screws are passed from the top in FIG. 1 and screwed to a mounting plate which is disposed below the door operator, however not illustrated in FIG. 1.

FIG. 2*a* shows a perspective view of the gear housing 2, wherein the shell elements 3 and 4 are shown in a condition where they are brought into mutual abutment.

Furthermore, the groove guide 10 is visible which forms the reception tunnel 8. The gear housing 2 is furthermore configured such as to be able to mount further components to the shell elements 3 and 4 or to retain them there. An incremental encoder 27 and a radio set 29 are shown in an airborne position in front of the gear housing 2.

The incremental encoder 27 has a latching moulding 35, which can be inserted into a latching recess 36 in the lower area of the shell element 3. Furthermore, a screw connection 41 is shown, by means of which the incremental encoder 27 can be fastened to the shell element 3. The gear housing 2, respectively the half-shell 4 thereof has preferably insert openings 47, into which the projecting pins of the incremental encoder 27 engage, respectively of the housing thereof, and fix the incremental encoder 27 in the mounting position.

Furthermore, a shaft passage 28 is provided in the shell element 3, through which a shaft section of the gear can extend, in order to cooperate with the incremental encoder 27.

According to the illustration, an electrical line 7 is installed at the gear housing 2 in a predetermined position. The dome-shaped fastening mouldings 6*a* form a projection which allows for the defined guidance of the electrical line 7 at the gear housing 2.

In addition, the radio set 29 is mountable via the fastening pin 37 to the shell element 3, wherein the signal line 42 can be likewise received for being guided by the dome-shaped fastening mouldings 6*b*. At the top side, the gear housing 2 has a first plane surface area 24 of the shell element 4 and a second plane surface area 25 of the shell element 3, the plane surface area 24 and 25 together forming the plane surface 26. A flat cable, which runs through the door operator, can be held and guided across the plane surface 26.

It is furthermore preferred the incremental encoder 27 has at least one reception 27*a* for one of the aforementioned attachment screws. The exterior dimensions of the respective attachment screw are preferably almost identical or slightly larger than the reception 27*a*. The respective attachment screw is thereby held only by the reception 27*a*. This way, already during manufacturing, the incremental encoder can be equipped with the attachment screw(s) which makes mounting easier.

FIG. 2*b* shows a perspective view of the gear housing 2 from the other side of the gear housing 2, when compared to FIG. 2*a*. As revealed, the shell element 4 as well has fastening mouldings 6*a* preferably in the fastening area of the motor flange 9, between which the line 7*a* is installed preferably in a clamping manner.

FIG. 2*b* furthermore reveals that the motor flange 9 preferably likewise has a flat cable guide 50. By way of example, the flat cable guide 50 is formed by an exterior side, respectively exterior surface of the motor flange 9, pointing at a slant to the top right, as a seating surface 51 for the non-illustrated flat cable. Sections 52, which protrude from the seating surface 51 in the direction in which the seating surface 51 points, are configured at lateral terminal areas of the seating surface 51 in FIG. 2*b*. At free ends, the sections 52 have preferably again respectively one projection 53. In this case, the projections 53 extend towards each other such that they, together with the sections 52 and the seating surface 51, form a reception compartment for the flat cable.

The first shell element 3 is individually shown in a perspective view in FIGS. 3 and 4. In FIG. 4, both the incremental encoder 27 and the radio set 29 are illustrated in a position mounted to the shell element 3. For attaching the incremental encoder 27, the fastening moulding 35 is introduced into the latching recess 36. Furthermore, the screw connection 41 is illustrated, by means of which the incremental encoder 27 is disposed accurately positioned at the shell element 3. FIG. 3 shows the shaft passage 28, which serves for a shaft of the gear to pass therethrough. This shaft may cooperate with the incremental encoder 27, in order to detect for example the angle of rotation of the output shaft of the door operator 1 and to transmit the information about the angle of rotation of the output shaft to the control of the door operator, for example via the signal line 42. At the top side, the shell element 3 has the plane surface area 25, which is a part of the plane surface 26. At the front side, the shell element 3 has a reception surface 16 for disposing a non-illustrated spring force accumulator 15, wherein a collar section 20 is shown, which serves for positioning a likewise non-illustrated liner plate 17. According to the illustration, the shell element 3 has a geometrical shape which allows for manufacturing the shell element 3 in a casting process. The casting process may be a metal casting process, a metal die-casting process or a plastic material injection moulding process such that the shell elements 3 and 4 may be manufactured from a metallic material, for example aluminium or magnesium material or from a plastic material.

FIG. 5 shows another perspective view of the gear housing 2 wherein the shell elements 3 and 4 are shown in a position where they are brought into mutual abutment. The reception surface 16 for receiving the spring force accumulator 15 is composed of partial surfaces at the shell elements 3 and 4, whereas the collar sections 19 and 20 furthermore are united to form a ring-shaped surrounding collar 18. Insert recesses 23, in which the insert projections 22 of the spring force accumulator 15 can engage, are provided in the reception surface 16. The insert recesses 23 thus realize a reception of the spring force accumulator 15 locked against rotation with regard to the gear housing 2. A final fastening by means of the attachment screws 43 is thereby simplified.

It is furthermore preferred a liner plate 17, having a centring opening 21, be disposed between the spring force accumulator 15 and the reception surface 16. The collar 18 extends through the centring opening 21 such as to achieve a rigidity-increasing effect, because the shell elements 3 and 4 can not be pushed any further away from each other. The illustrated screw elements 43 allow for a screw connection of the liner plate 17 at the reception surface 16 by screwing the screw elements 43 in the threaded bores 44. A through-opening 45 is shown in the shell element 3, through which opening a push rod may extend, which may be a component of a closing sequence control of a double-leaf door system. Preferably the liner plate 17 has through-openings, which are not identified in detail, aligned with the insert openings 23 in the mounting position, and preferably configured in cross-section like the respective aligned insert opening 23.

Thus, the spring tube, with its end facing the gear housing 2, leads to the liner plate 17 or is stationarily affixed to the latter for example by means of riveting.

FIG. 6 shows a perspective view of the door operator 1, which has a system carrier 30 in or at which further components, such as a control 46, are received. The control 46 is connected to a flat cable 32, which is guided via a flat cable guide 31 across the motor 33 and the gear housing 2. At the upper side, the gear housing 2 has the plane surface 26, which is essentially covered by the flat cable guide 32, wherein however the plane surface 26 serves for guiding the flat cable 32 at the top side.

FIG. 7 shows a variant of the gear housing 2. The housing 2 has a plurality of external ribs 54 reinforcing the housing 2. It is thereby possible to reduce the wall thickness of the gear housing 2 and thus to save material.

The invention in its configuration is not limited to the above indicated preferred embodiment. On the contrary, a number of variants are conceivable, which make use of the described solution likewise with basically different types of executions. All features and/or advantages, including the constructional details, spatial dispositions and process steps, resulting from the claims, the description or the drawings, may be essential to the invention, both by themselves and in their various combinations. In particular the inventive gear housing 2 is not limited to the illustrated detailed geometry of the shell elements 3 and 4. The plane of division, extending between the shell elements 3 and 4, may likewise extend in a plane rotated by 90°.

The collar 18 and the through-opening 21 in the liner plate 17 may take different forms, for example a rectangular form.

LIST OF REFERENCES

1 door operator
2 gear housing
3 shell element
3*a* attachment opening
4 shell element
5 inner gear compartment
6*a* fastening moulding
6*b* fastening moulding
7 electrical line
8 reception tunnel
9 flange element
10 groove guide
11 guide section
12 screw element
13 insert opening
14 threaded bore
15 spring force accumulator
16 reception surface
17 liner plate
18 collar
19 collar section
20 collar section
21 centring opening
22 insert projection
23 insert recess
24 plane surface area
25 plane surface area
26 plane surface
27 incremental encoder
27*a* screw reception
28 shaft passage
29 radio set
30 system carrier
31 flat cable guide
32 flat cable
33 motor
34 breakthrough
35 latching moulding
36 latching recess
37 fastening pin
38 opening side
39 worm wheel axis
40 shoulder
41 screw connection
42 signal line
43 screw element
44 threaded bore
45 through-opening
46 control
47 insert opening
50 flat cable guide
51 seating surface
52 protruding section
53 projection
54 rib

The invention claimed is:

1. A door operator comprising:

a drive unit having a gear with a gear housing, the gear housing comprising:

a flange element having a guide section, the guide section configured for at least one of bearing and supporting a gear member of a motor, the motor is mountable to the gear housing via the flange element;

at least one first shell element;

at least one second shell element configured to form:

(a) an inner gear compartment when the first and the second shell elements are brought into mutual abutment, and (b) a reception tunnel in which the flange element is received via the guide section in a groove guide provided in the reception tunnel;

at least one projection at a side of the guide section, the at least one projection facing one of the first and the second shell elements;

at least one insert opening arranged in at least one of the first and the second shell elements corresponding to the at least one projection such that, when the at least one of the first and the second shell elements is placed onto the guide section, the at least one projection engages in the at least one insert opening; and a spring force accumulator received in a reception surface of the gear housing via a liner plate having a central opening, the liner plate being disposed between the spring force accumulator and the reception surface, wherein the reception surface is formed by the first and the second shell elements in the joined condition.

2. The door operator according to claim 1, wherein the first and the second shell elements are selected from the group consisting of a metallic cast component, a metallic die-cast component, and a plastic material injection moulded component.

3. The door operator according to claim 1, wherein the first and the second shell elements further comprise a plurality of respectively associated fastening mouldings by which the first and the second shell elements are interconnectable by screw elements.

4. The door operator according to claim 3, wherein at least one of the plural respectively associated fastening mouldings forms a moulding projection configured for a defined at least one of guiding and affixing at least one electrical line at the gear housing.

5. The door operator according to claim 4, wherein the moulding projection has a threaded bore, into which a screw element is screwed from a side of the at least one of the shell elements facing away from the guide section, while passing through the insert recess.

6. The door operator according to claim 1, wherein the liner plate is provided in a flat abutment of the reception surface.

7. The door operator according to claim 6, wherein a ring-shaped collar projects from the reception surface, the ring-shaped collar comprising respective collar sections of the first and the second shell elements, the ring-shaped collar configured to receive the liner plate in a centering manner in that the collar is configured to be inserted into a centering opening provided in the liner plate.

8. The door operator according to claim 6, wherein the liner plate is screwed to the shell elements.

9. The door operator according to claim 1, wherein the first and the second shell elements have respective plane surface areas configured at the upper side, which, when the first and the second shell elements are brought into mutual abutment, extend in a common planar surface.

10. The door operator according to claim 1, further comprising an incremental encoder disposed at the outside of the first and the second shell elements.

11. The door operator according to claim 10, wherein a shaft passage is provided in the one of the first and the second shell elements receiving the incremental encoder, through which passage a transmission shaft extends, to cooperate with the incremental encoder.

12. The door operator according to claim 1, further comprising a radio set disposed at the outside of the first and the second shell elements.

13. The door operator according to claim 9, further comprising at least one system carrier having a flat cable guide configured together with the plane surface for guiding a flat cable.

14. The door operator according to claim 1, wherein the gear housing is provided with a plurality of reinforcing ribs.

15. The door operator according to claim 6, wherein the spring force accumulator has at least one insert projection that is inserted into at least one associated insert recess in the first and the second shell elements.

* * * * *